United States Patent [19]

Pisz et al.

[11] Patent Number: 4,915,587

[45] Date of Patent: Apr. 10, 1990

[54] APPARATUS FOR LOCKING SIDE ENTRY BLADES INTO A ROTOR

[75] Inventors: Frank A. Pisz, Titusville; Leroy D. McLaurin, Winter Springs; George A. Gergely, Stuart; John P. Donlan, Oviedo, all of Fla.

[73] Assignee: Westinghouse Electric Corp., Pittsburgh, Pa.

[21] Appl. No.: 261,668

[22] Filed: Oct. 24, 1988

[51] Int. Cl.[4] ..... F01D 5/32

[52] U.S. Cl. ..... 416/220 R; 416/221

[58] Field of Search ..... 416/193 A, 220 R, 221, 416/219, 218

[56] References Cited

U.S. PATENT DOCUMENTS

| | | | |
|---|---|---|---|
| 1,890,581 | 12/1932 | Köhler | 416/219 R |
| 2,751,189 | 6/1956 | Ledwith | 416/217 |
| 2,753,149 | 7/1956 | Kurti . | |
| 2,843,356 | 7/1958 | Hull . | |
| 2,867,408 | 1/1959 | Kolb et al. . | |
| 2,942,842 | 6/1960 | Hayes | 416/221 |
| 2,949,278 | 8/1960 | McCormick | 416/220 R |
| 2,994,507 | 8/1961 | Keller et al. | 416/221 |
| 3,001,760 | 9/1961 | Guernsey et al. | 416/221 |
| 3,202,398 | 8/1965 | Webb . | |
| 3,309,058 | 3/1967 | Blackhurst et al. | 416/220 R |
| 3,393,862 | 7/1968 | Harrison | 416/220 R |
| 3,759,633 | 9/1973 | Tournere | 416/220 |
| 4,050,850 | 9/1977 | Beckershoff | 416/221 |
| 4,466,776 | 8/1984 | Camboulives | 416/221 |
| 4,676,723 | 6/1987 | Kiger et al. | 416/221 |

FOREIGN PATENT DOCUMENTS

| | | |
|---|---|---|
| 54-130710 | 10/1979 | Japan . |
| 313027 | 3/1956 | Switzerland . |

*Primary Examiner*—Everette A. Powell, Jr.
*Attorney, Agent, or Firm*—K. Bach

[57] ABSTRACT

An apparatus and method is provided for locking side entry blades, in a rotor, such as used in compressors, turbines and fans. The apparatus utilizes arcuate locking devices retained in a circumferential groove in the periphery of the rotor. Each locking device features a key which engages a keyway in the side of the blade root shank. Use of the locking devices does not require that the blades having abutting platforms.

15 Claims, 6 Drawing Sheets

APPARATUS FOR LOCKING SIDE ENTRY BLADES INTO A ROTOR

BACKGROUND OF THE INVENTION

1. Field of the Invention

The present invention relates to rotors, such as those used in compressors, fans and turbines. More specifically, to an apparatus for locking side entry blades into such rotors.

2. Description of the Prior Art

Compressors, fans, turbines and like machinery employ rotors to which a plurality of blades are affixed. Such blades are arranged into one or more rows spaced axially along the rotor, the blades in each row being circumferentially arrayed around the periphery of the rotor.

As a result of the high steady and vibratory forces imposed on the blades during operation, the method of attaching the blades to the rotor requires careful design. One method of attachment employs approximately axially extending grooves formed in the rotor periphery. The shape of the grooves may be that of a fir-tree, semicircle, inverted T, or some variation thereof. Each blade has a corresponding root portion at its base which is closely profiled to match the shape of the rotor grooves. Each blade is retained in the rotor by sliding the root of the blade into a rotor groove. Blades affixed to the rotor in this manner are referred to as side entry blades. As a result of the close match in the size and shape of the blade root and the rotor groove, motion of the blade in the tangential and radial directions is closely restrained. However, restraint of the blade in the axial direction, referred to as locking, requires a separate device. In the past, a variety of locking devices have been devised. Generally they can be divided into two categories depending on the location of the point of fixity.

The first category of locking devices applies to blades in which a platform is formed at the base of each blade airfoil, the platforms of adjacent blades abutting one another thereby forming a ring surrounding the periphery of the rotor. In such arrangements the locking device is usually employed at the periphery of the rotor. One approach, disclosed in U.S. Pat. No. 4,676,723, involves a tangential locking pin which straddles a groove in the rotor periphery and a mating groove in the underside of the blade platform. A second approach, disclosed in U.S. Pat. No. Nos. 2,867,408 and 2,843,356 and Swiss Patent No. 313,027, involves a locking plate, the lower portion of the plate resides in a tangential slot in the rotor periphery and the upper portion in a slot in the edge of the platform. A third approach, disclosed in U.S. Pat. No. 3,202,398, employs a locking plate which resides in an axial channel in the rotor periphery and features tabs on the ends of the plate which can be bent against the front and rear faces of the platform. A fourth approach, disclosed in U.S. Pat. No. 3,001,760, relies on a spring clip residing, at its base, in a tangential slot in the rotor periphery, and at its upper portion, in a radially aligned matching slot in the edge of the blade platform. In each of these approaches the retention of the locking device in a simple groove or slot is made possible by the cooperation of the abutting platform of the adjacent blade.

The second category of locking devices applies to blades without abutting platforms at the base of the airfoil and, hence, which cannot rely on the platforms to retain the locking device. In this arrangement, the locking device is usually employed at the bottom of the rotor groove. One approach, disclosed in Japanese Patent No. 54-130710, involves a locking plate which resides in an axial channel in the bottom of the groove and features tabs at both end of the locking plate which can be bent against the upstream and downstream faces of the blade root. A second approach, disclosed in U.S. Pat. No. 2,753,149, utilizes a rivet disposed in mating axial grooves in the base of the blade root and the bottom of the rotor groove. A third approach, disclosed in U.S. Pat. No. 3,759,633, utilizes balls disposed in mating semi-spherical depressions in the base of the blade root and the bottom of the rotor groove. A fourth approach, disclosed in U.S. Pat. No. 4,466,776, employs two tangential keys disposed in slots in the front and rear of the base of the blade root, the key being retained by tab-like projections emanating from its ends which are bent against the sides of the root.

The compressor rotors of gas turbines designed by the assignee of the present invention incorporate blades in which the airfoils emanate directly from the blade roots without intervening platforms. Hence, locking devices of the aforementioned first category, which rely on cooperation of the blade platforms to retain the locking devices, cannot be utilized. Instead, in the past, axial motion was restrained by a radially oriented spring and pin. In this approach each blade is installed by first disposing a spring in a hole in the bottom of the rotor groove and compressing the spring by forcing a pin into the hole on top of the spring. The blade root is slid into the groove and is locked when a slot, machined in the bottom of the root, passes over the pin, allowing the spring force to drive the pin partially out of the hole and into the slot. Blades are removed by applying an axial force to the blade root sufficient to shear the pin in half, allowing the blade to be withdrawn.

However, this approach suffers from several disadvantages. Firstly the locking device is hidden from view and its correct installation cannot be ascertained visually once the blade is inserted into the groove. Since there may be well over 1,000 blades in each rotor, this disadvantage makes inspection of the rotor for proper locking difficult and time-consuming. However, a single unlocked compressor blade, should it come loose in service, may result in substantial damage to the rotating blades and stationary vanes of the compressor and render the gas turbine unavailable for use until repaired. It should be noted that many of the locking devices utilized in the prior art suffer from a similar disadvantage.

A second disadvantage occurs because the bottom of the groove is a highly stressed region of the rotor and the presence of the hole serves to concentrate these stresses, thereby exacerbating the potential for cracking.

A third disadvantage concerns the strength of the locking device. As explained below, pins have been known to fail in service, resulting in unlocking of the blades.

During full speed operation the blades are urged axially forward by the pressure rise across the row of blades. The centrifugal force on the blades is very high however. Hence there is more than adequate frictional resistance in the blade roots to prevent them from sliding forward. However, when a gas turbine is shut down, its rotor is not allowed to come to rest immediately. Instead the rotor is usually rotated at low speed until it cools sufficiently to prevent gravity from forming a bow in the hot rotor since such a bow would result in high vibration during the next start up. This cooling time may be in the order of several days. During the cooling period, distortion may occur in the compressor cylinder due to non-uniformities in the temperature distribution within the cylinder, causing the tips of the rotating blades to contact the cylinder, a phenomenon known as blade tip rubbing. Since the compressor cylinder converges slightly as it extends rearward, to accommodate the reduced flow area required by the air as it undergoes compression, the tip rubbing gives rise to an axial force tending to urge the blades forward. Since during the cooling period the centrifugal force on the blades is nil, there is little frictional resistance to sliding in the groove. Consequently, the axial force imparted by the tip rubbing is transmitted to the pin. However, the pins must be weak enough to allow them to be sheared so that the blades can be removed, as previously explained, without damaging the holes in the rotor grooves or the slots in the blade roots in which they reside. Hence, if the tip rubbing is severe, it may result in shearing the pin in half, thus unlocking the blade. As explained previously, an unlocked blade may result in significant compressor damage.

This third disadvantage is exacerbated on recently designed compressors owing to the necessity for coating the blade roots with a lubricant to avoid fretting fatigue cracking of the blade root or rotor groove as a result of vibratory loading on the blades. The lubricant coating reduces the coefficient of friction between the root and groove, thus reducing the severity of tip rubbing required to shear a locking pin.

It should be noted that the other locking devices described as being in the second category, and therefore applicable to rotors whose blades do not feature abutting platforms, suffer from a similar limitation in the ability of the locking device to withstand a large axial force induced by tip rubbing.

Lastly, many of the locking schemes utilized in the prior art, such as disclosed in aforementioned U.S. Pat. Nos. 4,676,723; 2,867,408 and 2,843,356; Swiss Patent No. 313,027 and Japanese Patent No. 54-130710 require that the last blade, or next to the last blade, installed be of a special type. Such a requirement increases the quantity of blades which must be stocked in inventory and is, therefore, to be avoided.

It is therefore desirable to provide an apparatus for locking side entry blades, of the type without abutting platforms, which allows for visible inspection of the locking devices, is capable of withstanding large axial forces without loss of locking function and which allows removal of the blades without damage to the blades or rotor.

SUMMARY OF THE INVENTION

Accordingly, it is the general object of the present invention to provide means for locking side entry blades.

More specifically, it is an object of the present invention to provide means for locking side entry blades without abutting platforms.

It is still another object of the present invention to provide a locking means which allows visible inspection of the locking means, is capable of withstanding large axial forces without loss of locking function, allows removal of the blades without damage to the rotor or blades, and does not require that any of the blades be of a special type.

These objects are accomplished in a rotor having approximately axially extending grooves spaced around its periphery in which rotating blades are retained. According to the present invention, a circumferentially extending slot, whose cross-section is shaped as an inverted T, is formed in the rotor periphery and an arcuate locking device is disposed in the slot between each pair of adjacent grooves. A key in one end of the locking device is engaged in a notch in the blade shank, thereby preventing axial movement. Disengagement of the key is prevented by the shank of the adjacent blade root. In rotors with widely pitched blades, arcuate spacer pieces are inserted in the circumferential slot adjacent to the locking devices, spanning the portion of the slot between the locking device and the shank of the adjacent blade root.

According to one important aspect of the invention, a special two-piece locking device with deformable lugs is used to lock the last blade installed. Thus the last blade may be of the standard type.

DESCRIPTION OF THE PREFERRED EMBODIMENT

Figure 1:
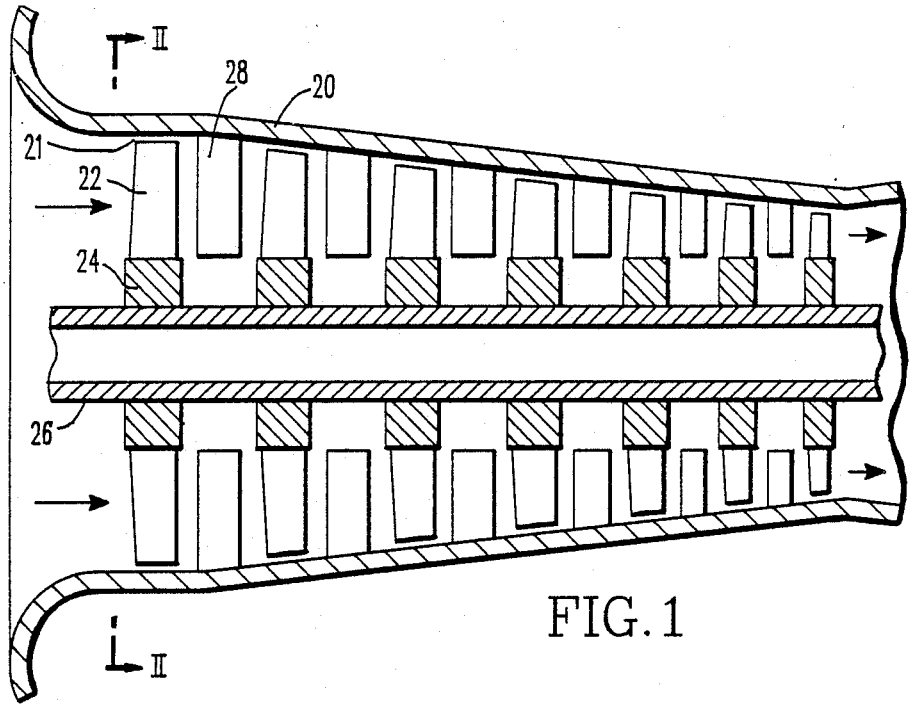
FIG. 1 is a longitudinal cross-section of an axial flow compressor, showing the rotor and compressor cylinder.
Figure 2:
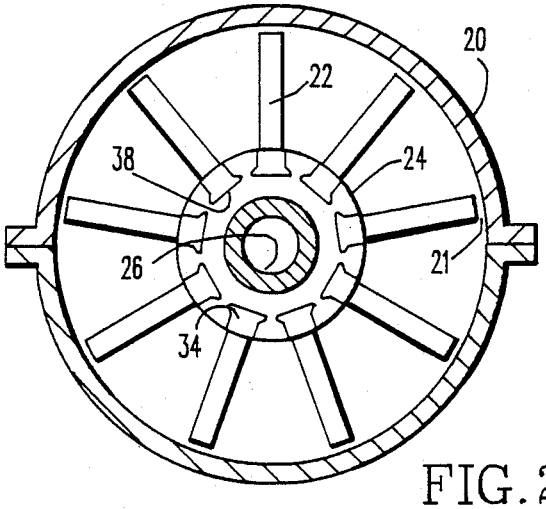
FIG. 2 is a cross-section taken through line II—II of FIG. 1, showing a row of rotating blades.

Referring to the drawings wherein like numerals represent like elements, there is illustrated in FIG. 1 an axial flow compressor, such as is used in a gas turbine, the arrows indicating the direction of flow of the fluid being compressed. The compressor is comprised of a cylinder 20 into which a rotor is centrally disposed. The rotor is comprised of a shaft 26 on which a plurality of disks 24 are axially spaced. As shown in FIG. 2 for the first disk, which is typical, a plurality of blades 22 are affixed to the periphery of the disk 24 forming a row, each row of blades rotating along with the shaft within the cylinder 20, there being a small radial clearance 21 between the tip of each blade and the inner surface of the cylinder 20. A plurality of stationary vanes 28 are fixed to the inner surface of the cylinder forming rows which are interposed between the rows of rotating blades 22, as shown in FIG. 1.

Figure 3:
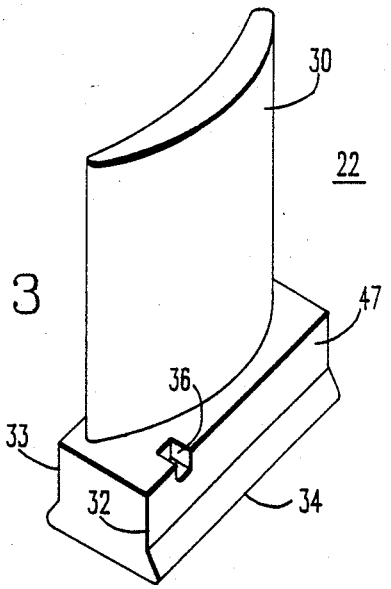
FIG. 3 is a perspective view of a compressor blade showing a notch in the shank of the root in accordance with the current invention.

As shown in FIG. 3, each blade 22 is comprised of an airfoil 30 and a root 34, the airfoil emanates from the root directly, hence there is no platform at the base of the blade. The upper portion of the blade root forms a shank 47 having two approximately axially extending sides 32 and 33. The size and the shape of the blade roots 34 closely match those of axially extending grooves 38 spaced about the periphery of the disk 24, shown in FIG. 4. Each blade is retained in the disk by sliding the root 34 of the blade into its respective groove 38, as shown in FIG. 5.

In operation, the blades are urged in the radial direction by the centrifugal force exerted on them as a result of their rotation and in the tangential direction by the aerodynamic force exerted on them as a result of the air flow. However, the close match in the size and shape of the blade root and groove prevents movement of the blades in the radial and tangential directions. The blades are also urged axially forward during operation by a relatively small force exerted on them by the pressure rise across the row. This axial force is more than compensated for by the frictional resistance generated between the contact surfaces of the blade root and groove as a result of the centrifugal force on the blade. Hence no axial movement occurs. However, when the rotor is operated at very low speeds, such as during the cooling period as previously discussed, a small clearance between the blade root and groove, necessary for machining tolerances, allows the blades to flop from side to side during rotation. Hence, it is necessary to restrain the blades in the axial direction, referred to as locking, to prevent them from gradually migrating out of the groove as they flop from side to side. As previously explained, thermal distortion of the cylinder during the cooling period can result in the tips of the blade airfoils rubbing against the inner surface of the cylinder due to a loss of radial tip clearance 21. This rubbing generates large axial forces on the blades as a result of the convergence of the cylinder as it extends rearward, as shown in FIG. 1. Consequently, the locking means must be capable of withstanding a large axial force.

Figure 4:
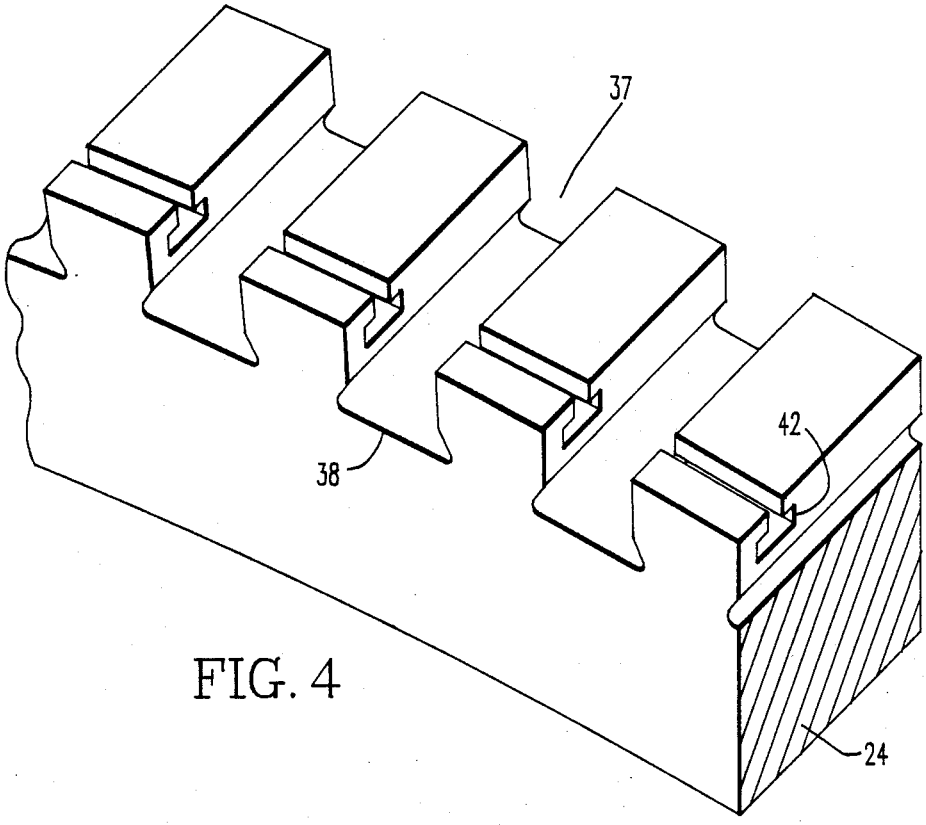
FIG. 4 is a perspective view of a portion of the periphery of a rotor disk, showing the circumferential slot according to the present invention.
Figure 5:
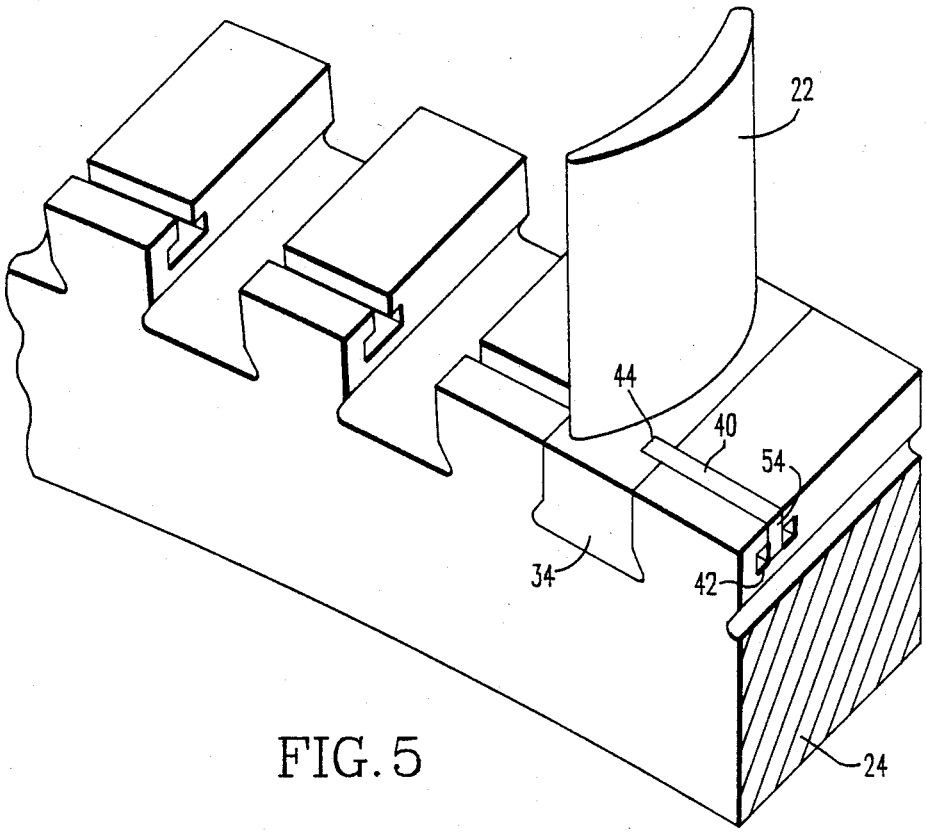
FIG. 5 is a perspective view of the compressor blade shown in FIG. 3 installed in the disk shown in FIG. 4 and locked in accordance with the present invention.
Figure 7:
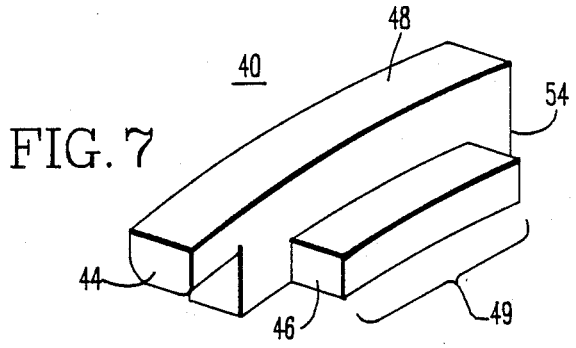
FIG. 7 is a perspective view of a locking device suitable for use with closely pitched blades in accordance with the current invention.
Figure 8:
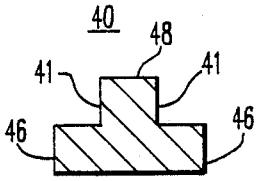
FIG. 8 is a vertical cross-section through the locking device shown in FIG. 7.

According to the present invention, locking is enabled by machining a notch or keyway 36 in side 32 of each blade root shank 47, as shown in FIG. 3, and machining a circumferential slot 42 around the periphery of the rotor disk 24, as shown in FIG. 4, such that a portion of the circumferential slot 42 is formed between each adjacent pair of grooves 38. The slot may have a cross-section shaped as an inverted T, or any other suitable shape so long as the width of the slot at its base is wider than the width at its periphery to facilitate retention of locking devices. A locking device, comprising an arcuate member, is provided for each blade root. One type of locking device 40 is shown in FIG. 7. The radius of curvature of the outer surface of the center portion 48 of the locking device 40 matches that of the disk periphery so that when installed, as shown in FIG. 5, an aerodynamically smooth surface is obtained. A key 44 is formed at one end of the locking device which is insertable into the keyway 36 in the blade root. The shape of the cross-section of the locking device is similar to that of the circumferential slot and rails 46, which mate with the slot 42 to support the centrifugal load on the device and restrain motion in the radial direction, emanate from the sides 41 of the locking device, as shown in FIG. 8.

Figure 6:
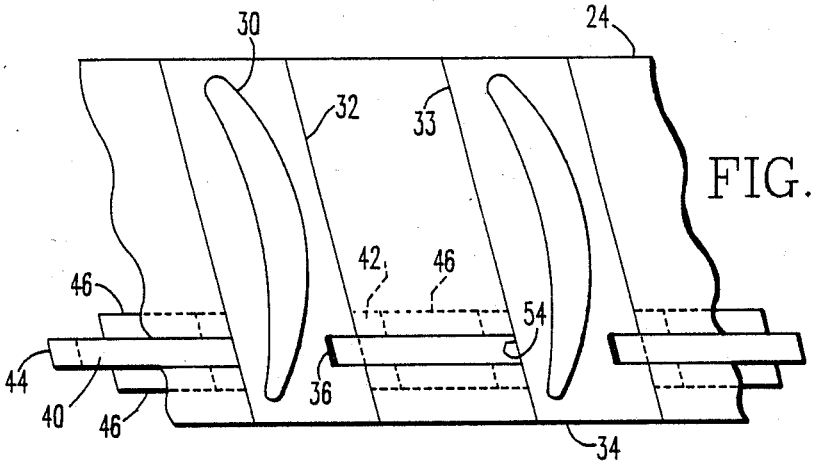
FIG. 6 is a plan view of a portion of the periphery of the rotor disk shown in FIG. 4, showing two closely pitched blades locked in accordance with the current invention.

Blades are installed and locked in the rotor sequentially. A blade root is slid into a groove and a locking device 40 is inserted into the empty groove adjacent to the side 32 of the blade root shank which contains the keyway 36. The length 49 of the support rails 46, as shown in FIG. 7, is less than the width 37 of the upper portion of the grooves 38, shown in FIG. 3. Hence, the locking device can be inserted into the groove and slid tangentially into the slot 42 so that its key 44 engages the keyway 36 in the blade root, as shown in FIGS. 5 and 6. Subsequently, the next blade is installed in the aforementioned adjacent groove and the procedure repeated until all but the last blade is installed. Each locking device 40 extends from the keyway of the locked blade to the adjacent blade root so that, as shown in FIG. 6, end 54 of the locking device 40 abuts side 33 of the adjacent blade root. Thus disengagement of the keys is prevented by restraining the motion of the locking devices in the circumferential direction.

Figure 11:
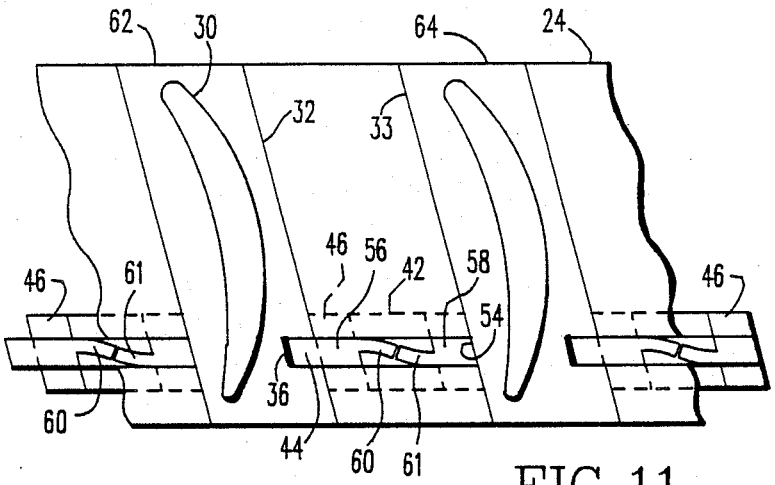
FIG. 11 is a plan view of a portion of the periphery of the rotor disk showing the locking, in accordance with the current invention, of the last blade installed.
Figure 12:
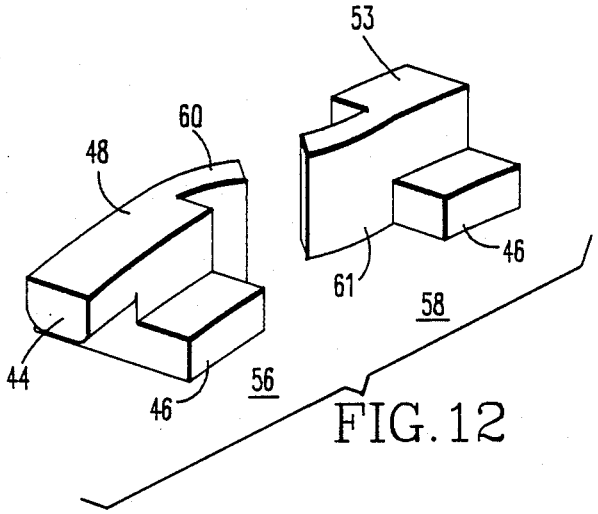
FIG. 12 is a plan view of the locking device and spacer, shown in FIG. 11, for locking the last blade.

In accordance with an important aspect of the invention, a special locking device 56 and spacer 58, shown in FIG. 12, are used to lock the last blade installed. The special locking device 56 is similar to the standard locking device 40 except that it is shorter and features a deformable lug 60 emanating from the end opposite the key 44. The width of the deformable lug 60 is approximately half the thickness of the center portion 48 of the locking device 56. The spacer 58 features a similar lug 61 oriented on the opposite side of its center portion 53. Prior to inserting the last blade 62, shown in FIG. 11, the spacer 53 is inserted into the last groove and slid into the circumferential slot 42, so that its end opposite the lug 61 abuts side 33 of the shank of the first blade installed 64. The special locking device is slid into the slot next, so that the lugs 60 and 61 slide past one another. In this state the combined length of the special locking device and the spacer is less than the distance between the shank of the last blade 62 and the shank of the first blade 64 thereby allowing the last blade 62 to be slid into the last groove. The locking device is then slid against the last blade, so that its key engages the keyway in the last blade, and the lugs 60 and 61 are bent axially rearward and forward, respectively, so that they abut one another. Since the combined length of the special locking device and the spacer now approximately equals the distance between the keyway in the last blade and the shank of the first blade disengagement of the locking device is prevented by restraining the motion of the locking device in the circumferential direction.

It should be noted that inspection of the locking device for proper installation is readily done since insertion of the key 44 into the keyway 36 is easily visible. Further, the strength of the lock, and hence its ability to withstand axial force, may be made as great as necessary by increasing the thickness of the key 44. Also note that the last blade is locked as securely as the other blades, and no special modifications are necessary on the last blade, thus simplifying stocking requirements. Disassembly may be readily accomplished by bending back the deformable lugs on special locking device and spacer used to lock the last blade and reversing the installation procedure. Thus, the strength of the locking devices is not limited by the fact that the keys must be sheared or broken to remove the blades.

Figure 9:
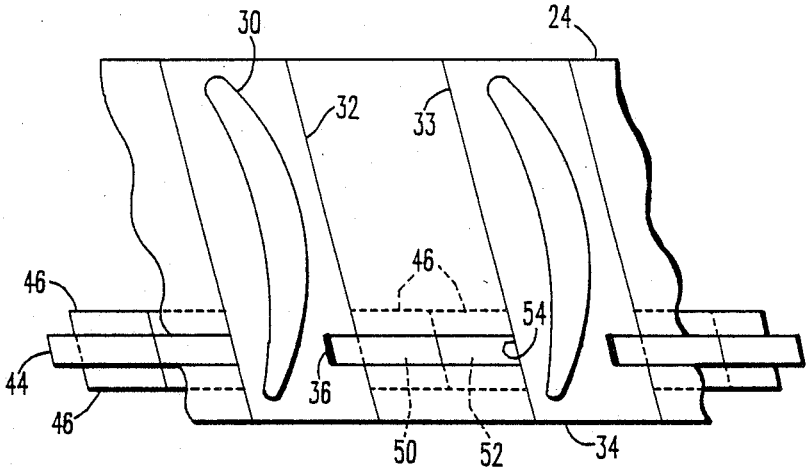
FIG. 9 is a plan view of a portion of the periphery of the rotor disk shown in FIG. 4, showing two widely pitched blades locked in accordance with the current invention.
Figure 10:
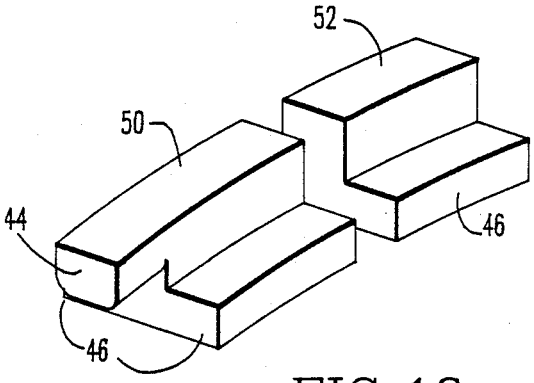
FIG. 10 is a perspective view of a locking device and spacer piece suitable for use with widely pitched blades in accordance with the current invention.

The locking device 40, previously described, is most applicable for closely pitched blades, that is blades in which the circumferential distance between adjacent blades is small, such as those shown in FIG. 6. When blades are widely pitched, such as those shown in FIG. 9, the circumferential distance between adjacent blades is greater, and consequently the length of the center portion 48 of the locking device must also be greater. This results in increased centrifugal force imposed on the support rails 46. However, as previously explained, to allow insertion of the locking device, the length 49 of the support rails is limited to the width 37 of the upper portion of the groove. Hence, the situation may arise wherein the length of the support rails is insufficient to support the centrifugal force on the locking device. According to the present invention, this problem is solved by utilizing the locking device 50 and spacer 52, shown in FIG. 10. The spacer is disposed in the circular slot, one end of the spacer abuts the locking device and the other end abuts the shank of the adjacent blade root, as shown in FIG. 9. Thus, by spanning the portion of the circumferential slot between the locking device and the adjacent blade root, disengagement of the key is prevented by restraining the motion of the locking device in the circumferential direction as before. By splitting the locking device into two pieces thusly, the length of the support rails can be made long enough to support the centrifugal force on them, yet short enough to allow insertion into the upper portion of the grooves.

It should be noted that although the invention has been described as incorporated in the axial flow compressor of a gas turbine, it is applicable to any rotor featuring side entry blades.

Many modifications and variations of the present invention are possible in light of the above techniques. It is therefore to be understood that within the scope of the appended claims, the invention may be practiced otherwise than as specifically described.

We claim:

1. A gas turbine, said gas turbine having a rotor, comprising:

(a) a plurality of approximately axially extending grooves, spaced about the periphery of said rotor in a row;

(b) a blade for each of said grooves, each of said blades having an airfoil portion and a blade root portion, said airfoils emanating directly from said blade roots without intervening platforms, each of said blade roots having first and second approximately axially extending sides formed therein, said blade roots adapted to be sequentially installed in said rotor by slidably entering said grooves in such a manner as to restrain relative movement of said blades in all but the direction in which said grooves extend;

(c) a circumferential slot disposed around the periphery of said rotor, a portion of said circumferential slot being disposed between each adjacent pair of said grooves;

(d) a locking device for each of said blade roots, each of said locking devices disposed in said circumferential slot between each adjacent pair of said blade roots;

(e) a first spacer disposed in said circumferential slot adjacent to the one of said locking devices locking the last of said blades installed in said row; and (f) said first spacer and said last blade locking device each having a deformable lug, said lugs opposing one another, said lugs having means for preventing motion of said last blade locking device in the circumferential direction when said lugs are in a deformed state.

2. The gas turbine according to claim 1 wherein each of said locking devices has first and second ends, means for engaging said blade roots being formed on each of said first ends, each of said locking devices being adapted to enter any of said grooves radially and slide circumferentially into said circumferential slot until said locking device engages its respective blade root, thereby restraining axial movement of said blade.

3. The gas turbine according to claim 2 wherein each of said locking devices, except the one of said locking devices locking the last of said blades installed in said row, spans said portion of said circumferential slot between adjacent blade roots.

4. The gas turbine according to claim 3 wherein said lug on said last blade locking device is formed on said second end of said locking device, said first spacer having first and second ends, said lug on said first spacer being formed on said first end of said first spacer, said lugs being adapted to slide past one another in said circumferential slot unless said lugs are in a deformed state whereupon said lugs abut one another, the combined length of said last blade locking device and said first spacer when said lugs have been slid past one another is such as to enable said last blade locking device and said first spacer to reside in said circumferential slot without said last blade locking device engaging said last blade, and the combined length of said last blade locking device and said first spacer when said lugs abut one another is such as to cause said first end of said last blade locking device to engage said last blade.

5. The gas turbine according to claim 4, wherein:

(a) the width of said circumferential slot is greater at its base than at its periphery; and (b) the width of each of said locking devices is greater at its base than at its periphery, whereby said locking devices mate with said circumferential slot thereby restraining the motion of said locking devices in the radial direction.

6. The gas turbine according to claim 5 further comprising a keyway formed in said first approximately axially extending side of each of said blade roots, said keyways registering with said circumferential slot.

7. The gas turbine according to claim 6 wherein said means for engaging said blade roots comprises a key formed in each of said first ends of said locking devices, said keys being insertable into said keyways in said blade roots, thereby enabling each of said locking devices to engage its respective blade root and restrain axial movement.

8. The gas turbine according to claim 7 wherein said circumferential slot and each of said locking devices have a cross-section shaped as an inverted T, each of said locking devices having a center portion forming the vertical portion of said T, support rails emanating axially from each of said center portions, said support rails forming the horizontal portion of said T.

9. The gas turbine according to claim 8 wherein each of said approximately axially extending grooves in said rotor has upper and lower portions, the circumferential length of said support rails being less than the width of said upper portions of said grooves, thereby enabling said locking devices to enter any of said grooves radially and slide into said circumferential slot.

10. The gas turbine according to claim 9 wherein said deformed state of said lugs comprises one of said lugs being bent in an axial direction and the other of said lugs being bent in an opposite axial direction.

11. The gas turbine according to claim 7 wherein each of said locking devices, except said last blade locking device, comprises a locking piece having first and second ends and a second spacer, each of said second spacers disposed in said circumferential slot adjacent to its respective locking piece, each of said second spacers spanning the portion of said circumferential slot between said second end of its respective locking piece and said second approximately axially extending side of said adjacent blade root.

12. The gas turbine according to claim 11 wherein each of said locking pieces and each of said second spacers have a cross-section shaped as an inverted T, each of said locking pieces and second spacers having a center portion forming the vertical portion of said T, support rails emanating axially from each of said center portions, said support rails forming the horizontal portion of said T.

13. The gas turbine according to claim 12 wherein each of said approximately axially extending grooves in said rotor has upper and lower portions, the circumferential length of said support rails of each of said locking pieces and each of said second spacers being less than the width of said upper portions of said grooves, thereby enabling said locking pieces and said second spacers to individually enter any of said grooves radially and slid into said circumferential slot.

14. The gas turbine according to claim 5 wherein said locking device comprises an arcuate member, the radius of curvature of said arcuate member being essentially the same as the radius of the periphery of said rotor.

15. The gas turbine according to claim 1 wherein each of said blades in said row is interchangeable with every other blade in said row.

* * * * *